US007644879B2

(12) United States Patent
Wu

(10) Patent No.: US 7,644,879 B2
(45) Date of Patent: Jan. 12, 2010

(54) NOZZLE OF GAS STOVE

(76) Inventor: Sen-Yu Wu, No. 27, Alley 81, Lane 88, Wu-Chuan Road, Feng-Chou Village, Shen-Kang Country, Taichung Hsien (TW)

( * ) Notice: Subject to any disclaimer, the term of this patent is extended or adjusted under 35 U.S.C. 154(b) by 118 days.

(21) Appl. No.: 11/526,098

(22) Filed: Sep. 25, 2006

(65) Prior Publication Data

US 2008/0072894 A1 Mar. 27, 2008

(51) Int. Cl.
*B05B 1/30* (2006.01)

(52) U.S. Cl. ..... 239/569; 239/581.1; 239/581.2

(58) Field of Classification Search ..... 239/569, 239/578, 581.1, 581.2, 582.1; 137/625.3
See application file for complete search history.

(56) References Cited

U.S. PATENT DOCUMENTS 4,154,263 A * 5/1979 Cary ..... 137/625.3
4,360,040 A * 11/1982 Cove et al. ..... 137/625.3
4,431,028 A * 2/1984 Hendrick ..... 137/625.3
4,944,284 A * 7/1990 O'Quin ..... 126/41 R
5,413,087 A * 5/1995 Jean ..... 126/41 R

* cited by examiner

*Primary Examiner*—Davis Hwu

(57) ABSTRACT

A nozzle for both types of gas stove of liquefied petroleum gas and natural gas includes a nozzle and an adjustable member. The nozzle member includes a gas channel, a receiving portion communicated with the gas channel. The adjustable member is received in the receiving portion, which has a plurality of apertures thereon. The adjustable member is moved to various positions to have the predetermined apertures communicated with the gas channel respectively to provide different gas supplies for the gas stove of liquefied petroleum gas or natural gas.

4 Claims, 5 Drawing Sheets

NOZZLE OF GAS STOVE

BACKGROUND OF THE INVENTION

1. Field of the Invention

The present invention relates generally to a gas stove, and more particularly to a nozzle of a gas stove.

2. Description of the Related Art

A conventional gas stove includes a gas switch and a nozzle connected to the gas switch. The gas switch controls the gas mixing with air for burning. Conventional gas stove incorporates liquefied petroleum gas or natural gas to supply gas. The liquefied petroleum gas and natural gas have different pressure and output, such that the nozzles of gas stoves for liquefied petroleum gas and for natural gas are different. Typically, the nozzle for liquefied petroleum gas has a smaller hole, and the nozzle for natural gas has a greater hole. Manufacturers of gas stove have to prepare both types of the nozzles for different gas stoves, and that increases the cost of manufacture.

To fix this problem, there was a nozzle for both liquefied petroleum gas and natural gas. Such nozzle is provided with an adjustable member on the nozzle. The adjustable member is moved proximal or distal to the nozzle that could control the output of gas. In practice, when the adjustable member is moved against the nozzle, the nozzle has only one hole jetting gas out. In such condition, the nozzle is suitable to the gas stove of liquefied petroleum gas. On the contrary, when the adjustable member is moved away from the nozzle, the nozzle has plenty of holes jetting gas for the gas stove of natural gas.

Such nozzle may be suitable for both types of gas stove. But the inventor found the nozzle having air turbulence when the adjustable keeps a predetermined distance from the nozzle, and that makes the gas out unstable.

SUMMARY OF THE INVENTION

The primary objective of the present invention is to provide a nozzle of a gas stove suitable to both types of gas stoves for liquefied petroleum gas and natural gas.

The secondary objective of the present invention is to provide a nozzle of a gas stove, which has no air turbulence problem.

According to the objectives of the present invention, a nozzle for both types of gas stove of liquefied petroleum gas and natural gas includes a nozzle and an adjustable member. The nozzle member includes a gas channel, a receiving portion communicated with the gas channel. The adjustable member is received in the receiving portion, which has a plurality of apertures thereon. The adjustable member is moved to various positions to have the predetermined apertures communicated with the gas channel respectively to provide different gas supplies for the gas stove of liquefied petroleum gas or natural gas.

DETAILED DESCRIPTION OF THE INVENTION

Figure 1:
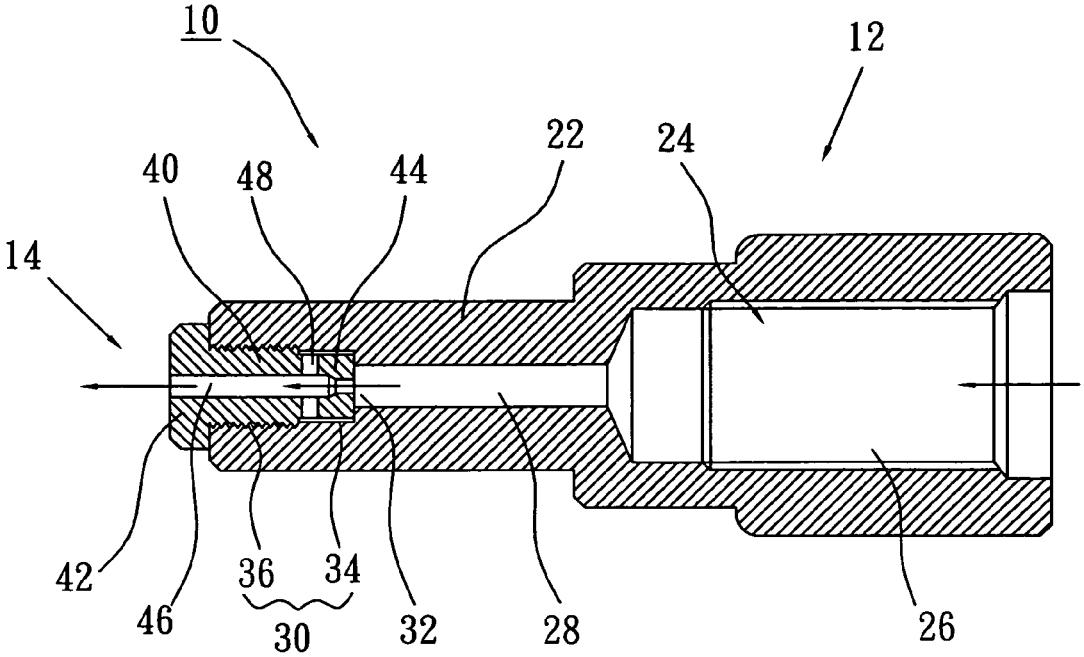
FIG. 1 is a sectional view of a first preferred embodiment of the present invention, showing the nozzle being adjusted for liquefied petroleum gas.

As shown in FIG. 1, a gas nozzle 10 of the first preferred embodiment of the present invention, which is connected a gas switch (not shown), includes a nozzle member 12 and an adjustable member 14.

The nozzle member 12 includes a tubular main member 22 with a gas channel 24. The gas channel 24 includes a greater diameter section 26, a smaller diameter section 28 and a receiving portion 30. The receiving portion 30 is communicated with the smaller diameter section 28. A check port 32 is formed between the smaller diameter section 28 and the receiving portion 30. The receiving portion 30 includes a ventilation section 34 and a connection section 36. The connection section 36 includes an inner thread.

The adjustable member 14 includes a block 40 with a driving portion 42 and a closing portion 44 opposite to the driving portion 42. The closing portion 44 of the block 40 may seal the check port 32, and there is a space between a sidewall of the ventilation section 34 and the closing portion 44. The driving portion 42 of the block 40 may be driven for rotation. The block 40 further has a connecting portion 45 with an outer thread to be meshed with the connection section 36, a first aperture 46 with opposite ends on the driving portion 42 and the closing portion 44, and two second apertures 48 on the closing portion 44 communicated with the first aperture 46 and the space that form an extra passageway to the first aperture 44.

In operation, when the nozzle 10 of the present invention is mounted on a gas stove of liquefied petroleum gas, the adjustable member 14 is turned to shift it in the receiving portion 30 to the check port 32 that makes gas flowing through the gas channel 24 only flows out through the first aperture 46. The gas supply is less which fits to the gas stove of liquefied petroleum gas.

Figure 2:
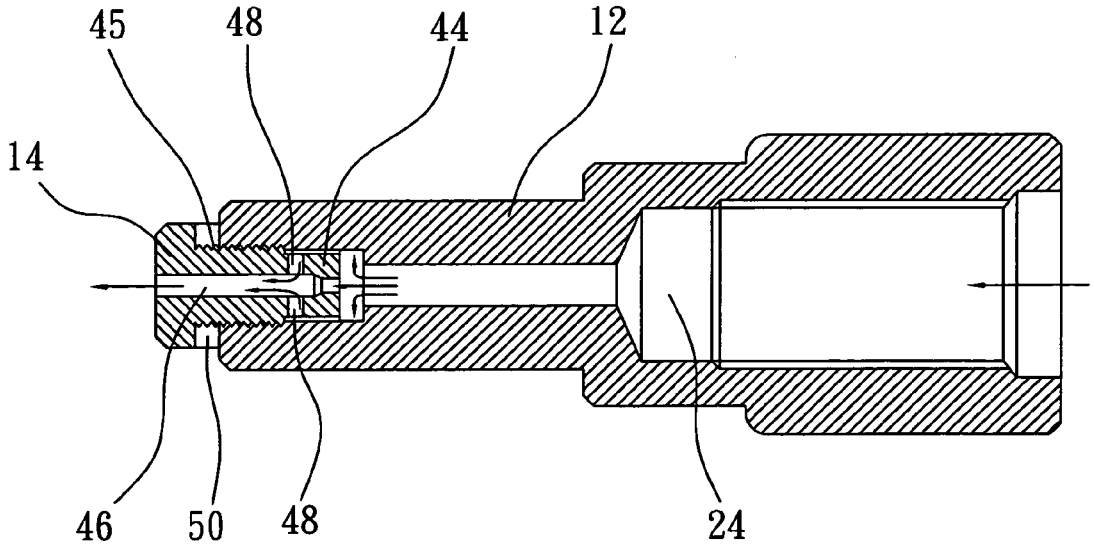
FIG. 2 is a sectional view of the first preferred embodiment of the present invention, showing the nozzle being adjusted for natural gas.

As shown in FIG. 2, when the nozzle 10 of the present invention is mounted in a gas stove of natural gas, the adjustable member 14 is turned to leave the check port 32 that the first aperture 46 is communicated with the second apertures 48. As a result, gas flowing through the gas channel 24 flows out through the first apertures 46, and the gas also flows to the first apertures 46 through the extra passageway that the gas supply is greater which fits to the gas stove of natural gas. A copper ring 50 is fitted to the block 40 between the driving portion 42 and the main member 22 in this condition.

The present invention provides the adjustable member being shifted relative to the check port 32 to open or close the extra passageway for adjustment of the gas supply that is suitable both of the gas stoves for liquefied petroleum gas and natural gas. In addition, the first aperture 46 is the only way flowing the gas out no matter the adjustable member 14 is adjusted for the gas stoves for liquefied petroleum gas or natural gas that make the nozzle 10 of the present invention has no problem of air turbulence.

Figure 3:
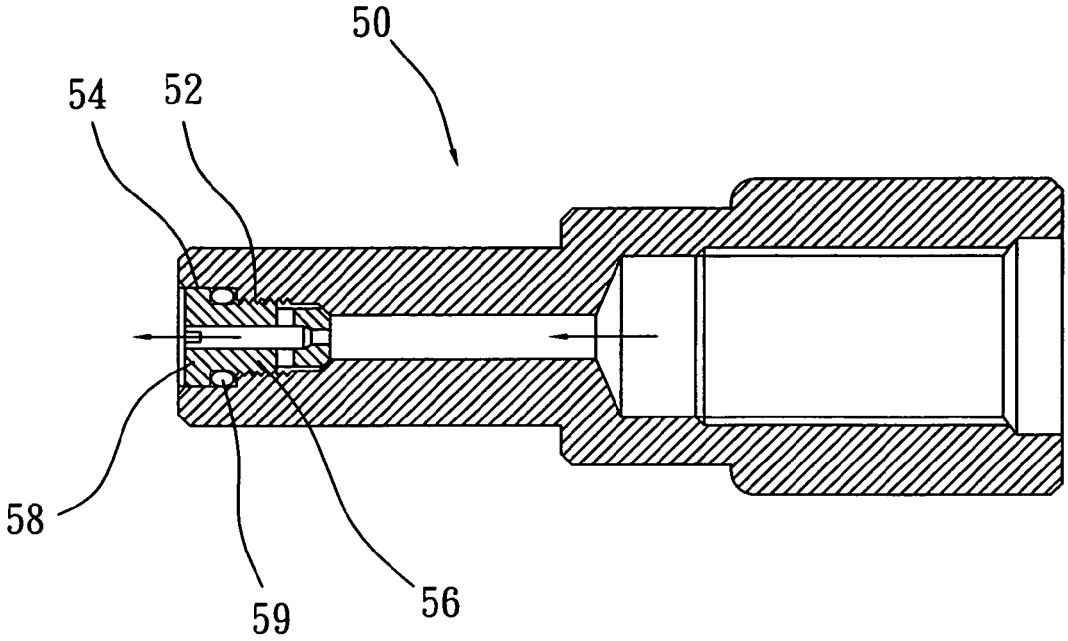
FIG. 3 is a sectional view of a second preferred embodiment of the present invention, showing the nozzle being adjusted for liquefied petroleum gas.
Figure 4:
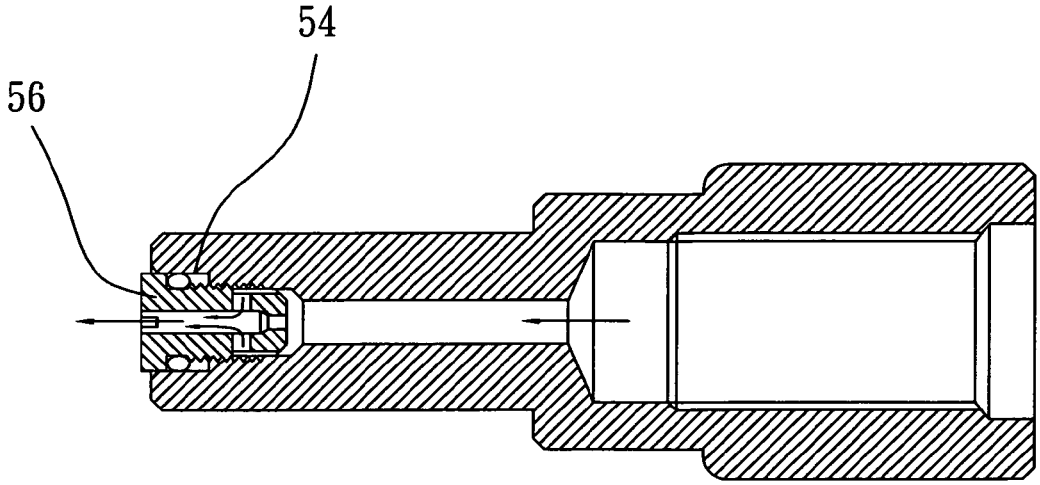
FIG. 4 is a sectional view of the second preferred embodiment of the present invention, showing the nozzle being adjusted for natural gas.

FIG. 3 and FIG. 4 shows a nozzle 50 of the second preferred embodiment, which is similar to the nozzle 10 of the first preferred embodiment, except that the nozzle 50 further includes a receiving portion 52 with a straight section 54, in which an adjustable member 56 is received, and a leakage-proof ring, which is made of silicon, fitted to a driving portion 58 of the adjustable member 56 and against the straight section 54. The operation and functions of the nozzle 50 of the second preferred embodiment are as same as the nozzle 10 of the first preferred embodiment.

Figure 5:
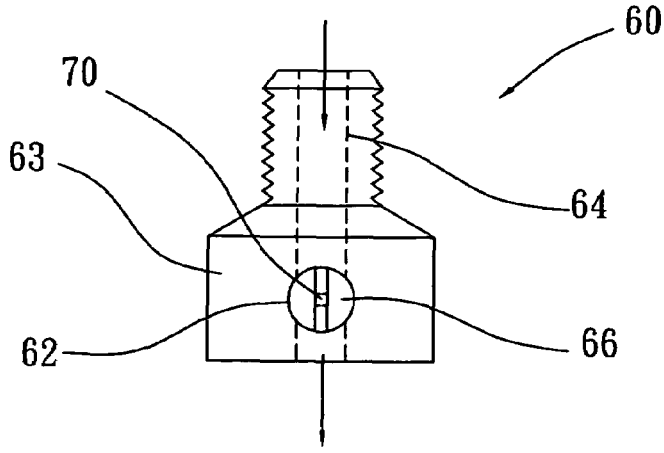
FIG. 5 is a perspective view of a third preferred embodiment of the present invention.
Figure 6:
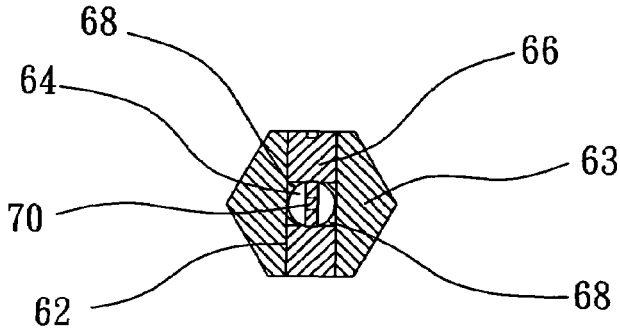
FIG. 6 is a sectional view of the third preferred embodiment of the present invention, showing the nozzle being adjusted for natural gas.
Figure 7:
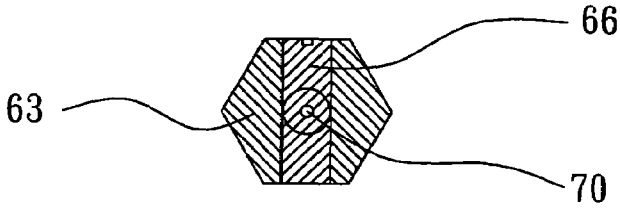
FIG. 7 is a sectional view of the third preferred embodiment of the present invention, showing the nozzle being adjusted for liquefied petroleum gas.

As shown in FIGS. 5 to 7, a nozzle 60 of the third preferred embodiment of the present invention includes a receiving portion 62 in a nozzle member 63 and transversely through a gas channel 64 thereof. An adjustable member 66 is received in the receiving portion 62. The adjustable member 66 is provided with two passageways 68 and an aperture 70 located in the gas channel 64. The passageways 68 are parallel and extended through the adjustable member 66 along a direction vertical to an axial direction thereof. The aperture 70 is extended between along a direction vertical to both of the axial direction of the adjustable member 66 and the passageways 68 and crosses the passageways 68. It may select gas flowing through the gas channel 64 via the passageways 68 or via the aperture 70 when the adjustable member 66 is turned.

As shown in FIG. 6, the adjustable member 66 is turned to have the passageways 68 aligned with the gas channel 64, in which gas flows through the passageways 68 to give a greater gas supply for the gas stove of liquefied petroleum gas. The adjustable member 66 also may be turned to have the aperture 70 aligned with the gas channel 64, as shown in FIG. 7, to give a less gas supply for the gas stove of natural gas.

Figure 8:
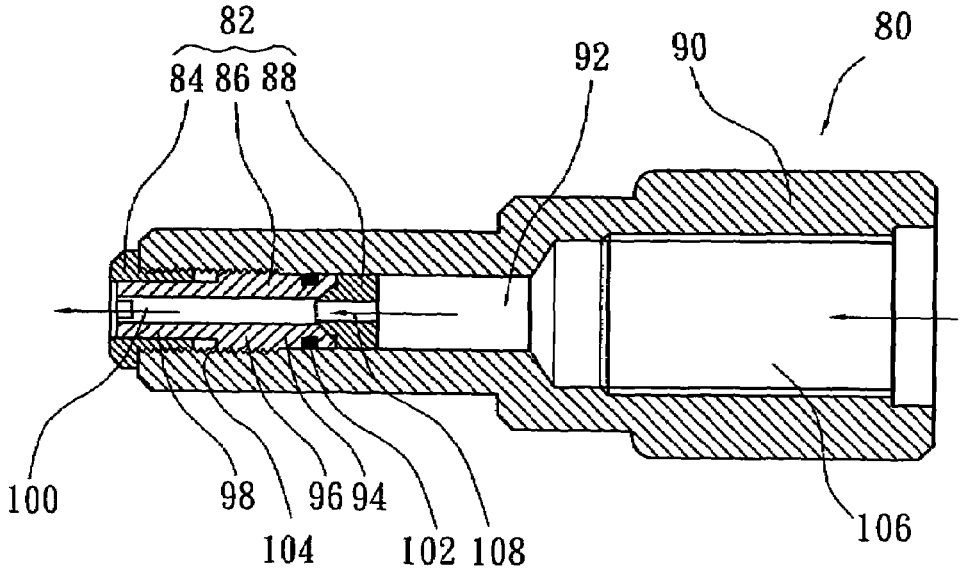
FIG. 8 is a sectional view of a fourth preferred embodiment of the present invention, showing the nozzle being adjusted for liquefied petroleum gas.
Figure 9:
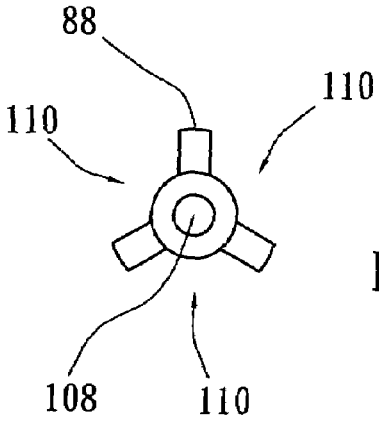
FIG. 9 is a lateral view of the guiding block of the fourth preferred embodiment of the present invention.
Figure 10:
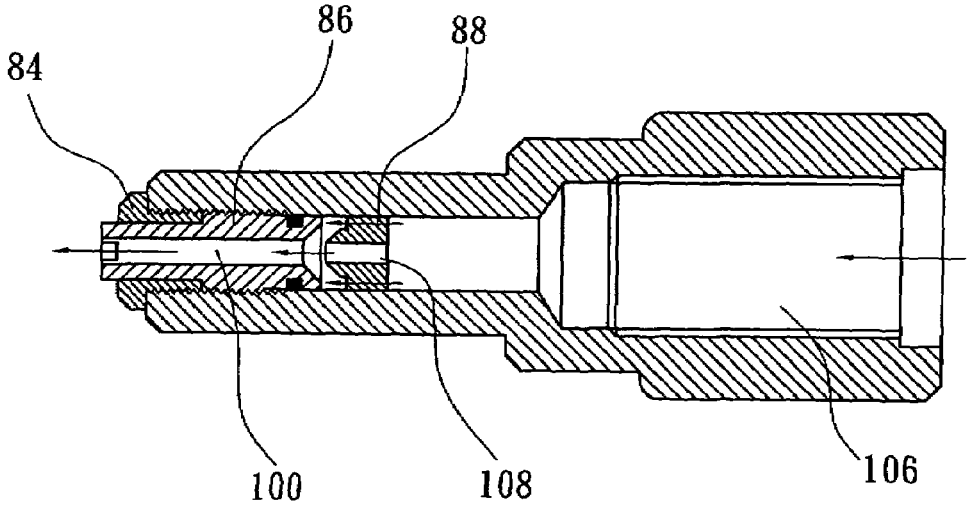
FIG. 10 is a sectional view of the fourth preferred embodiment of the present invention, showing the nozzle being adjusted for natural gas.

As shown in FIGS. 8 to 10, a nozzle 80 of the fourth preferred embodiment of the present invention includes an adjustable member 82 and a nozzle member 90. The adjustable member 82 includes a plug 84, an adjustable block 86 and a guiding block 88. The plug 84 has an outer thread to be screwed into a receiving portion 92 of the nozzle member 92, on a sidewall of which an inner thread is provided. The adjustable block 86 has an outer thread also to be screwed into the receiving portion 92 and under the plug 84. The adjustable block 86 includes a straight section 94, a driving section 98, the threaded section 96 provided with the outer thread between the straight section 94 and the driving section 98 and a aperture 100 through the three sections 94, 96 and 98. A leakage-proof ring 102 is fitted to the straight section 94. The threaded section 96 has an end face 104 facing the plug 84. The guiding block 88 is received in the receiving portion 92 too under the adjustable block 86 and communicated with a gas channel 106 of the nozzle member 90. The guiding block 88 includes a first passageway 108 and three second passageways 110 communicating the gas channel 106 and the receiving portion 92.

When the adjustable block 86 is turned for movement toward and against the guiding block 88, the second passageways 100 are sealed. Under such condition, gas only flows out through the first passageway 108 and the aperture 100 to give a less gas supply for the gas stove of liquefied petroleum gas. When the adjustable block 86 is turned oppositely to leave guiding block 88 and have the end face 104 against the plug 84, gas may flow through first passageway 108, the second passageways 110 and the aperture 100 to give a greater gas supply for the gas stove of natural gas.

Figure 11:
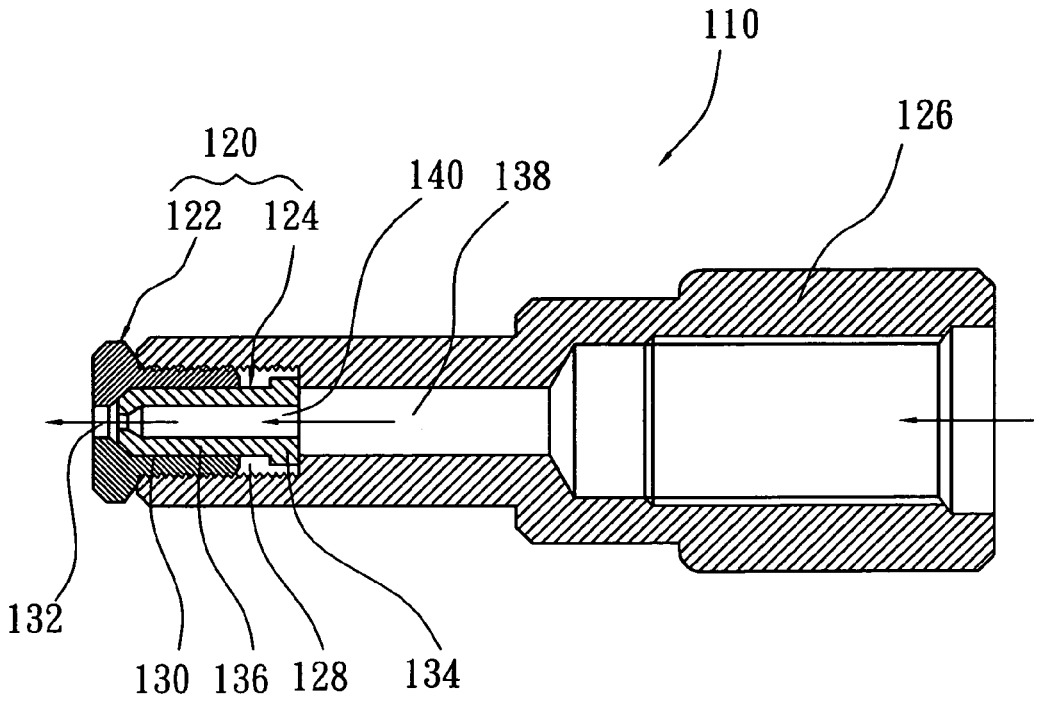
FIG. 11 is a sectional view of a fifth preferred embodiment of the present invention, showing the nozzle being adjusted for liquefied petroleum gas.
Figure 12:
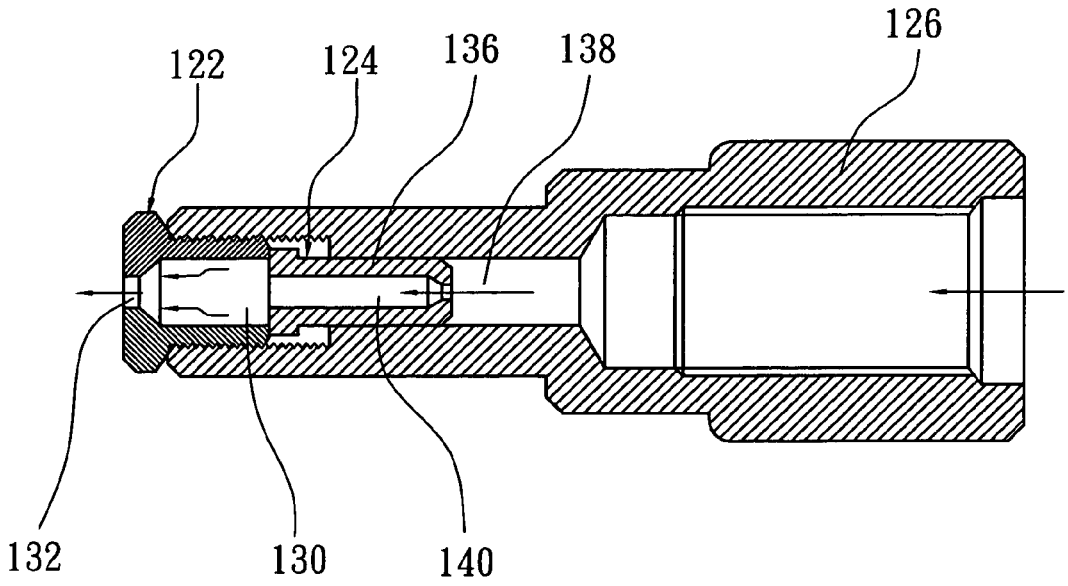
FIG. 12 is a sectional view of the fifth preferred embodiment of the present invention, showing the nozzle being adjusted for natural gas.

As shown in FIGS. 11 and 12, a nozzle 110 of the fifth preferred embodiment of the present invention includes an adjustable member 120 consisting of hollow plug 122 and an adjustable block 124. The plug 122 is screwed into a receiving portion 128 of a nozzle member 126 and includes a chamber 130 and an aperture 132 communicated with the chamber 130. The adjustable block 124 includes a base 134, a bar 136 with an end connected to the base 134 and a passageway 140 through the base 134 and the bar 136. The bar 136 has a diameter less than that of the base 134 to be selected to be inserted into a gas channel 138 of the nozzle member 138 or into the chamber 130 of the plug 122.

When the adjustable block 124 is turned to move the bar 136 to the chamber 130 of the plug, gas flows through the passageway 140 and the aperture 132 to give a less gas supply for the gas stove of liquefied petroleum gas. When the adjustable block 124 is turned to have the bar 136 in the gas channel 138, gas flows through the passageway 140 to the chamber 130 to give a greater gas supply for the gas stove of natural gas.

In conclusion, the present invention provides the adjustable member for manipulation to be moved in the receiving portion for adjustment of the gas supply. It is suitable to both of the gas stove for liquefied petroleum gas and natural gas. The nozzle of the present invention has a stable gas flow without the problem of air turbulence.

What is claimed is:

1. A nozzle for both types of gas stove of liquefied petroleum gas and natural gas, comprising:

a nozzle member including a gas channel, a receiving portion communicated with the gas channel; and an adjustable member received in the receiving portion, which has a plurality of apertures thereon, wherein the adjustable member is moved to various positions to have the predetermined apertures communicated with the gas channel respectively to provide different gas supplies for the gas stove of liquefied petroleum gas or natural gas, wherein the adjustable member includes a hollow plug provided on the nozzle member at an out end of the receiving portion and an adjustable block is receiving in the receiving portion for movement, wherein the adjustable block includes an aperture, and the adjustable member further includes a guiding block received in the receiving portion having a first passageway and a plurality of second passageways, wherein the first passageway is associated with the aperture of the adjustable block, and the second passageways are associated with an inner end of the adjustable block.

2. The nozzle as defined in claim 1, wherein the adjustable member includes a hollow plug at an outer end of the receiving portion, and the adjustable block is under the plug.

3. The nozzle as defined in claim 2, wherein the adjustable block includes a straight section associated with the guiding block, a threaded section having a thread meshed next to the straight section, which has a thread on a sidewall of the receiving portion, and a driving section next to the threaded section and received in the plug.

4. The nozzle as defined in claim 3, wherein the threaded section has an end face facing the plug.

* * * * *